United States Patent [19]

Allan

[11] Patent Number: 4,528,797

[45] Date of Patent: Jul. 16, 1985

[54] PLASTIC LID FITTING DEVICE

[76] Inventor: George G. Allan, 1715 W. 236th St., Torrance, Calif. 90501

[21] Appl. No.: 550,117

[22] Filed: Nov. 9, 1983

[51] Int. Cl.[3] ..... B65B 7/28; B67B 3/22

[52] U.S. Cl. ..... 53/312; 53/314

[58] Field of Search ..... 53/314, 316, 312, 313, 53/315, 306, 308, 300, 310, 311

[56] References Cited

U.S. PATENT DOCUMENTS 2,531,914 11/1950 Lager et al. ..... 53/314 X
3,040,494 6/1962 Anderson ..... 53/310 X
3,124,916 3/1964 Anderson et al. ..... 53/314 X
3,261,142 7/1966 Wilcox ..... 53/314 X

FOREIGN PATENT DOCUMENTS 2551299 5/1976 Fed. Rep. of Germany ..... 53/312

*Primary Examiner*—Horace M. Culver

[57] ABSTRACT

This lid fitting machine is designed to efficiently seal a plastic container filled with a food product, with a plastic lid. Primarily, it consists of a frame with a motor driven carrier chain, having feed arms for the transport and placement of lids on the filled containers. It also includes a hopper for containing the multiple number of lids, and it further includes a pair of cams, for the precise operation of lid placement onto the containers.

1 Claim, 6 Drawing Figures

FIG. 1
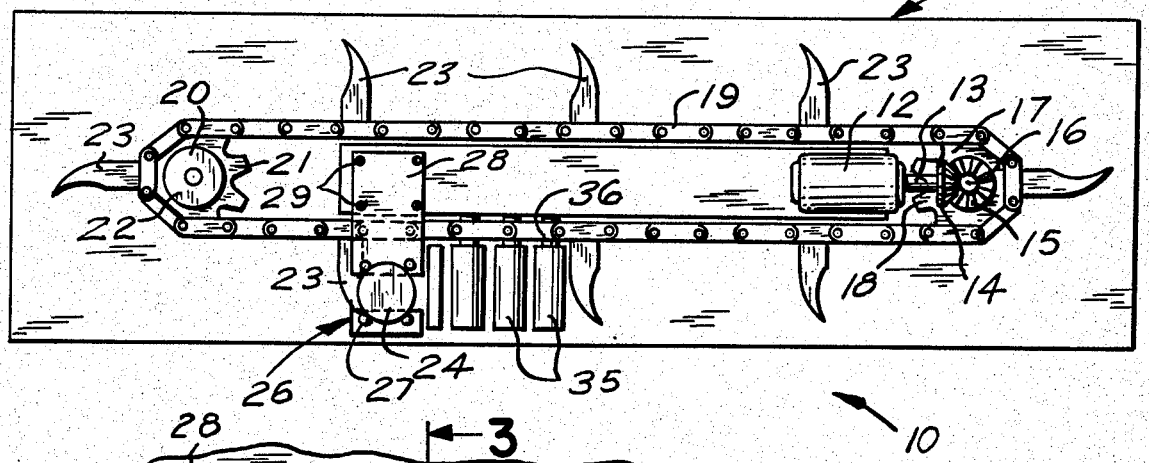
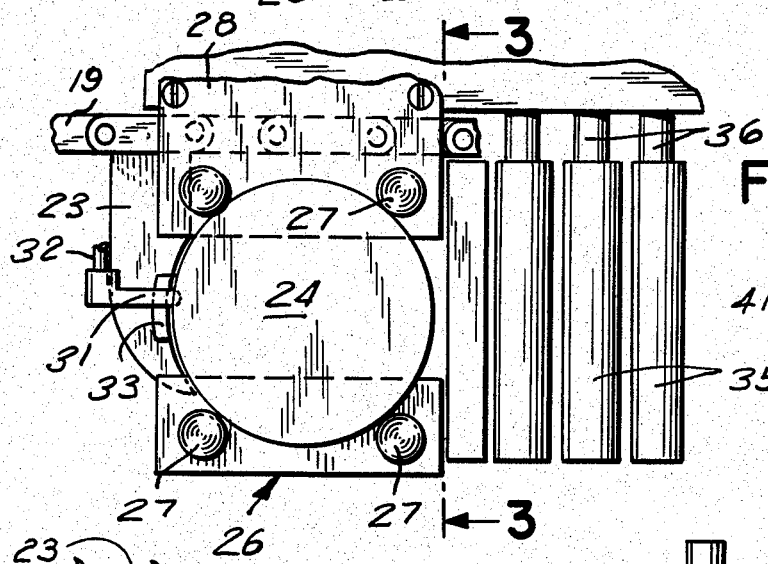
FIG. 2
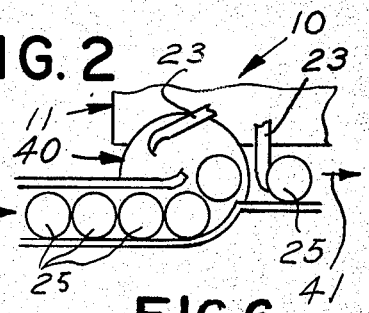
FIG. 6
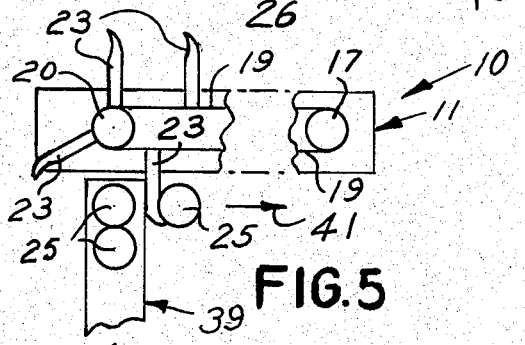
FIG. 5
FIG. 3
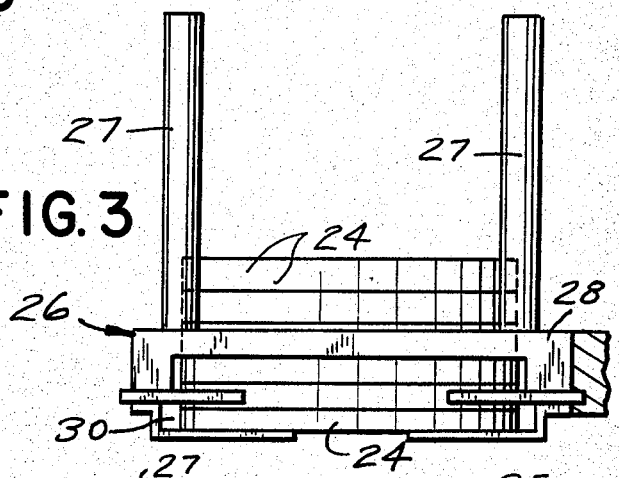
FIG. 4
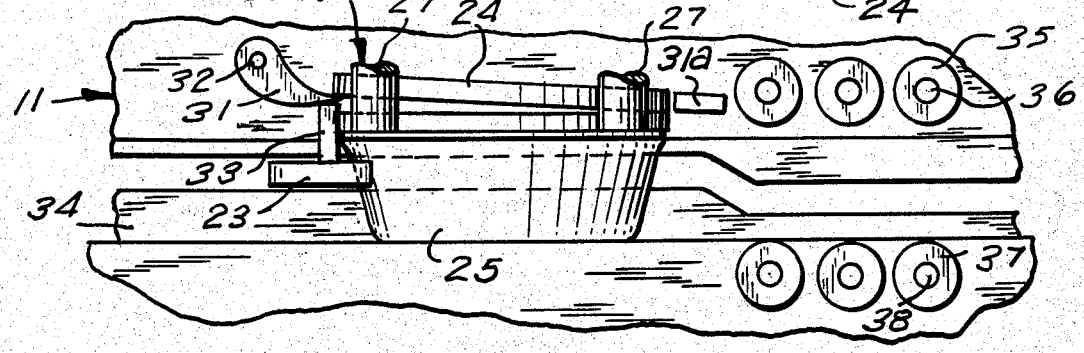

PLASTIC LID FITTING DEVICE

This invention relates to container closing machines, and more particularly, to a plastic lid fitting machine.

The principal object of this invention is to provide a plastic lid fitting machine, which will efficiently fit lids to plastic containers, such as are used for margarine, and the like.

Another object of this invention is to provide a plastic lid fitting machine, which will be adjustable for containers of various sizes.

A further object of this invention is to provide a plastic lid fitting machine, which will include cam means, for eliminating any inter-locking between a lid being ejected, and a lid remaining in the hopper of the machine.

Other objects are to provide a plastic lid fitting machine, which is simple in design, inexpensive to manufacture, rugged in construction, easy to use, and efficient in operation.

These, and other objects, will be readily evident, upon a study of the following specification, and the accompanying drawing, wherein:

FIG. 1 is a fragmentary top plan view of the present invention;

FIG. 2 is an enlarged fragmentary view of FIG. 1;

FIG. 3 is a cross-sectional view, taken along the line 3—3 of FIG. 2;

FIG. 4 is a fragmentary front elevational view, of the feed roller and cam device of the invention;

FIG. 5 is a fragmentary and diagrammatic top plan view of the invention, illustrating the feed of the containers, and FIG. 6 is similar to FIG. 4, but illustrates an alternate device for the feed of the containers.

Accordingly, a machine 10 is shown to include a top frame or plate 11, having an electric motor 12 suitably secured on a base plate 11*a*, by a plurality of fasteners, not shown. The shaft 13 of motor 12, is fixedly secured to a bevel gear 14, which engages a similar gear 15, suitably fastened to a vertical shaft 16, which is journaled in plate 11, in a manner, not shown. A sprocket 17, is also fixedly secured to shaft 16, in a suitable manner, and the teeth 18 thereof, engage with, and serve to drive endless chain 19, which is also carried on a second sprocket 20, having teeth 21, which is suitably and rigidly secured to a second vertical shaft 22. A plurality of equally spaced-apart pusher feed arms 23, are fixedly secured to, and extending from the outside of chain 19, and serve to engage with a lid 24, that is to seat on the top of a container 25. A plurality of lids 24, are received in hopper 26, which includes four radially spaced-apart, and vertical posts 27, that are fixedly secured to mounting plate 28, which is secured to base plate 11*a* by screw fasteners 29. Lids 24 are ejected from slot opening 30 of hopper 26, and a cam 31, is pivotally secured to a shaft 32, which is suitably secured to the side of plate 11 of machine 10. An angularly disposed plate 31*a* is fixedly secured, at one end, to the side of frame or plate 11, in a suitable manner, so as to deflect the front edge portion of lid 24 downward, to engage the front lip portion of the container 25, and it shall also be noted, that cam 31 functions to raise the lid 24 that is to remain in the hopper 26. Cam 31, is actuated by follower projection 33, which is fixedly secured, in a suitable manner, to each feed arm 23, so as to eliminate any interlocking between the lid 24 being ejected, and the lid 24 remaining in the hopper 26.

The feed arms 23, are controlled by cam 34, which holds the arm 23, together with the lid pusher or follower projection 33, in the raised position to eject a lid 24 from the hopper 26, and it shall be noted, that the top compression rollers 35 on shafts 36, are adjustable in elevation, so as to accommodate containers 25 of different sizes, and the lower compression rollers 37 on their respective shafts 38, are driven by a sliding key shaft, not shown, which is connected to the first roller 35, and the second, and the third rollers 35, are driven by intermediate mediate gears, also not shown. It shall also be recognized, that the cam 34 also serves to lower the pusher arms 23 clear of the rollers 35, as the lid 24 is pressed onto the containers 25.

The containers 25 are fed into machine 10 via a conveyer 39, or as an alternate, a turntable mechanism 40, as illustrated diagramatically in FIGS. 5 and 6 of the drawing, and the feed direction is indicated by the arrows 41. The curved portion of the arm 23 enables each container 25 to slide into position to be fed by the arm 23 into the machine 10, as the preceding container 25 is transported forward. A feed timing device is unnecessary, as long as sufficient containers 25 are accumulated to keep pushing a container 25 forward. After initial filling of conveyer 39 or mechanism 40, a P.E.C. or micro-switch, not shown, will stop the machine with several containers 25 in position for restarting, which is a procedure common in the art.

In use, hopper 26 is first filled with lids 24, and the circuit to motor 12 is closed, which drives chain 19. The feed arms 23 of chain 19, will then pass through slot 30. The arm 23, being attached to the carrier chain 19, by a pivot connector, which is common in the art, enables perpendicular movement, which is controlled by the cam 34. Cam 34 holds the arm 23 together with the lid pusher projection 33 in the raised position, to eject a lid 24 from the hopper 26, and then lowers the arm 23, as the lid 24 is pressed down onto the container 25.

While various changes may be made in the detail construction, it is understood that such changes will be within the spirit and scope of the present invention, as is defined by the appended claims.

What I now claim is:

1. A plastic lid fitting machine for placement of plastic lids on containers, comprising, in combination, a horizontal plate, an electric motor mounted on said plate, a bevel gear on a shaft of said motor engaging a gear on a first vertical shaft a sprocket on said first vertical shaft, an endless chain around said sprocket and also around a sprocket on a second vertical shaft, said shafts being journalled in said plate, a plurality of equally spaced-apart pusher feed arms mounted along said endless chain for engaging and pushing said lids, a lid hopper mounted upon said plate, said hopper including four upright, spaced-apart posts for storing a stack of said lids in their midst, a slot opening at a lower end of said hopper for ejection of a lowermost of said lids of said lid stack, a first cam pivoted on a horizontal shaft mounted on a side of said plate, an angular plate affixed at one end to said side of said plate for deflecting an edge of said lowermost lid downwardly and engage a front lip portion of the top of a container fed into said machine, said first cam raising said lids remaining in said hopper, a cam follower projection affixed on each of said pusher feed arms, so as to eliminate interlock between said lowermost lid and said remaining lids in said hopper, a second cam holding a said pusher feed arm together with said follower projection in a raised position, to effect an ejection of said lowermost lid from said hopper, and means for said second cam also to lower said pusher feed arms, so as to clear a row of top compression rollers as a lid is pressed upon a container.

* * * * *